United States Patent [19]

Mourier

[11] Patent Number: 4,636,689

[45] Date of Patent: Jan. 13, 1987

[54] MICROWAVE PROPAGATION MODE TRANSFORMER

[75] Inventor: Georges Mourier, Le Port Marly, France

[73] Assignee: Thomson-CSF, Paris, France

[21] Appl. No.: 589,565

[22] Filed: Mar. 14, 1984

[30] Foreign Application Priority Data

Mar. 18, 1983 [FR] France ..... 8304484

[51] Int. Cl.[4] ..... H01J 25/00

[52] U.S. Cl. ..... 315/4; 315/5; 333/21 R; 372/2

[58] Field of Search ..... 315/3, 4, 5; 372/2, 372/99; 333/21 R, 21 A

[56] References Cited

U.S. PATENT DOCUMENTS

| | | | |
|---|---|---|---|
| 2,923,903 | 2/1960 | Fox | 333/21 A |
| 3,710,258 | 1/1973 | Strenglein | 325/105 |
| 3,818,383 | 6/1974 | Willis | 333/21 A |
| 4,306,174 | 12/1981 | Mourier | 315/5 |
| 4,311,973 | 1/1982 | Nuding et al. | 333/21 A |
| 4,356,430 | 10/1982 | Stone et al. | 315/4 |
| 4,398,121 | 8/1983 | Chodorow et al. | 315/5 |

FOREIGN PATENT DOCUMENTS

| | | | |
|---|---|---|---|
| 0060922 | 5/1981 | European Pat. Off. | 315/4 |
| 2083691 | 3/1982 | United Kingdom | 315/4 |

OTHER PUBLICATIONS

IEEE Transactions on Microwave Theory and Techniques, vol. MTT-15, No. 2, T. Nakahara et al. "Guided Beam Waves Between Parallel Concave Reflectors".

*Primary Examiner*—Saxfield Chatmon
*Attorney, Agent, or Firm*—Roland Plottel

[57] ABSTRACT

This transformer (9) is formed by a waveguide, of approximately elliptical cross-section, and with increasing eccentricity (e) along the axis (z) of the transformer. This transformer (9) is connected on one side to the cavity (1) of a gyrotron (11) and on the other side to a section of guide (13) having the same cross-section as the final cross-section of the transformer and of which the cross-section is constant along the axis (z) of the transformer.

The transformer receives from the gyrotron cavity a complex mode, of $TE_{on}$ type, and changes said mode into a mode in which the electrical field is approximately parallel to a given direction (z). A system of two mirrors ($M_3$ and $M_4$) enables a single beam of plane waves (19) to be obtained from the two beams of plane waves (14 and 15) obtained at the output of the section of waveguide (13).

2 Claims, 16 Drawing Figures

MICROWAVE PROPAGATION MODE TRANSFORMER

BACKGROUND OF THE INVENTION

1. Field of the Invention

This invention relates to a microwave propagation mode transformer for millimetric power oscillators of gyrotron type, which functions on high modes.

2. Description of the Prior Art

The gyrotrons are now used for heating plasmas for the purpose of bringing them to a thermonuclear temperature. The problem that arises is that, in order to obtain a significant radiation, it is necessary to change from a complex mode, for example the $TE_{on}$ circular mode, which is produced in the rotation cavity of gyrotrons, to a mode in which the electrical field is linearly polarized and is therefore approximately parallel to a given direction, and even where it is preferable to change to a plane wave.

This invention solves the problem of changing from a complex mode, of $TE_{on}$ type, to a mode in which the electrical field is approximately parallel to a given direction, and even to a plane wave.

SUMMARY OF THE INVENTION

This invention relates to a microwave propagation mode transformer, formed by a waveguide, of approximately elliptical cross-section, and which increasing eccentricity along the axis of the transformer, wherein said transformer is connected to the cavity of a gyrotron which furnishes it a complex mode, of $TE_{on}$ type, said transformer changing said complex mode into a mode in which the electrical field is approximately parallel to a given direction.

BRIEF DESCRIPTION OF THE DRAWINGS

Other purposes, characteristics and results of the invention will be brought out by the following description, given as a non-limiting example and illustrated by the appended figures which represent.

DESCRIPTION OF THE PREFERRED EMBODIMENT(S)

The functioning of the mode transformer according to the invention will be explained with reference to FIGS. 1, 2 and 3.

Figure 1:
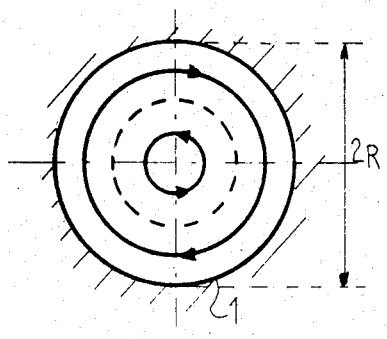
in FIGS. 1, 2 and 3, the electrical field lines in the cross-section of the cavity of a gyrotron, of an elliptical guide and of a system formed from two parallel conducting plates.

In FIG. 1, electrical field lines have been represented in the circular cross-section of the cavity 1 of a gyrotron, in the case in which a $TE_{02}$ mode is established in this cavity. The circles shown in a continuous line indicate the zones in which the electrical field is maximum and the circles shown in a dotted line indicate the zones in which the electrical field is zero. This mode $TE_{02}$ does not allow radiation.

Figure 2:
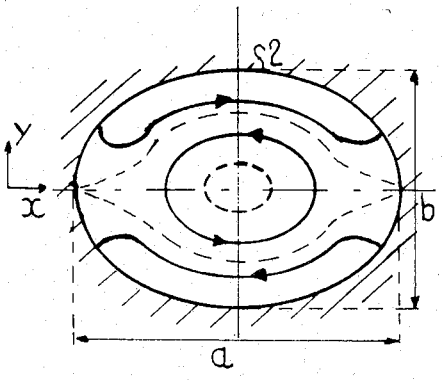

FIG. 2 shows the distribution of electrical field lines in the cross-section of a waveguide 2 of elliptical cross-section placed after the cavity of a gyrotron in which a $TE_{02}$ mode is established as in FIG. 1. a and b represent the major axis and the minor axis of the ellipse. In FIG. 2, the minor axis b is twice the internal radius R of the cavity of the gyrotron.

FIG. 2 shows that there is a considerable modification in the shape of the electrical field lines compared with FIG. 1. The electrical field lines become approximately parallel to the x direction shown in FIG. 2. It can be seen that towards the two extremities of the major axis, the electrical field is weak.

Figure 3:
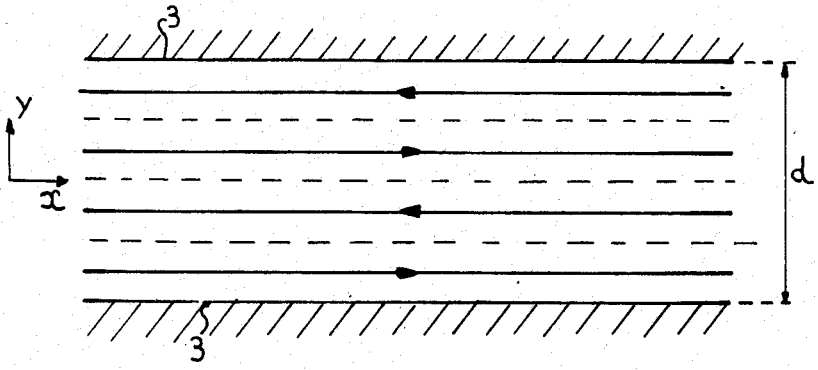

FIG. 3 shows the distribution of electrical field lines in the cross-section of a system formed from two parallel conducting plates, referenced 3. The distance d between the plates is set at twice the radius R of the cavity of the gyrotron. It is noted that the electrical field lines are parallel to the x direction. The mode transformer according to the invention changes the mode $TE_{02}$ established in the circular cross-section cavity and which does not allow radiation of gyrotron into a mode in which the electrical field is approximately parallel to the x direction using a waveguide of approximately elliptical cross-section, and of increasing eccentricity, and which allows significant radiation.

The eccentricity of an ellipse is defined by the following formula:

$$e=\sqrt{1=b^2/a^2}.$$

The eccentricity is zero when a equals b, i.e. when the ellipse becomes a circle.

As the major axis a tends towards infinity, the eccentricity of the ellipse tends towards 1.

The mode transformer according to the invention is formed by a waveguide of approximately elliptical cross-section, and of increasing eccentricity, i.e. the cross-section of this transformer has the shape of an ellipse of which the major axis a increases and tends towards the cross-section shown in FIG. 3 which is that of a system formed from two parallel plates which can be likened to the cross-section of an ellipse of eccentricity equal to 1. In the mode transformer according to the invention, the field lines have the distribution shown in FIG. 2 then tend towards the distribution of FIG. 3, i.e. as the eccentricity of the ellipse increases, the field lines become more and more parallel to the x direction.

What has just been explained for the $TE_{02}$ mode is similarly applicable to all the $TE_{on}$ modes. It will be seen in the rest of the description that the mode transformer according to the invention is applicable to other complex modes besides the $TE_{on}$ modes.

In the cavity of the gyrotron for the $TE_{02}$ mode, the frequency f and the radius R of the cavity are related by the following formula:

$$\omega=2\pi f\simeq 7.0156\cdot c/R\simeq(2\pi+0.7324)\cdot c/R$$

where c is the speed of light. This formula expresses that the frequency is very close to the cut-off frequency.

The cut-off-frequency $f_3$ of the system formed from two parallel conducting plates represented in FIG. 3 is written:

$$\omega_3=2\pi f_3=(4\pi c)/d$$

In the case where the distance d is equal to 2R, the following formula is obtained:

$$\omega/\omega_3=1.1166$$

The system of FIG. 3 is above the cut-off frequency. The following expressions are then obtained for the phase speed $V_\phi$ and the guided wavelength $\lambda_g$:

$$V_\phi=1/\sqrt{1-(\omega_3/\omega)^2}=2.2477c$$

$$\text{and } \lambda_g=2.2477\cdot\lambda.$$

It is therefore noted that when the minor axis b of the ellipse is constant, there is a transition from a standing wave in the gyrotron to a travelling wave in the transformer according to the invention.

When the minor axis b of the ellipse increases along the z axis, perpendicular to the x and y axes, the wave propagates the energy faster because the cut-off frequency diminushes. By adjusting this increase, it is therefore possible to modify the radiation impedance presented by the transformer according to the invention to the guide or to the circular cavity to which it is connected. This is what occurs in the circular cross-section horns which are usually connected to the cavity of a gyrotron and in which the radius increases with the z-axis coordinate.

The transformer according to the invention can be produced by forming a metallic deposit by means of electrolysis on a matrix as is done to produce waveguides.

Figure 4:
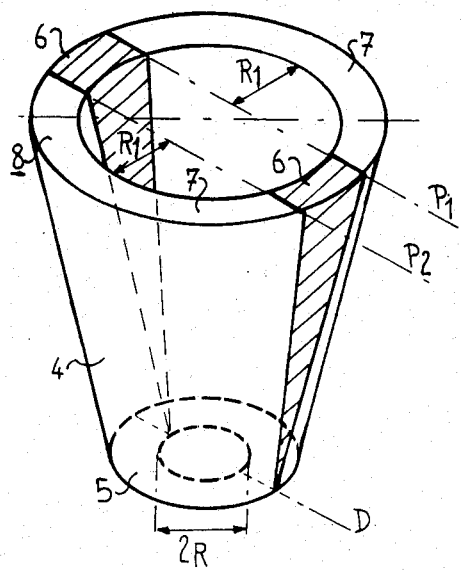
in FIG. 4, a process for obtaining a transformer according to the invention.

FIG. 4 illustrates another process of producing a transformer according to the invention.

We start from a section of cone 4 of which the radius of the small cross-section 5 is equal to R. This section of cone is sawn along two planes $P_1$ and $P_2$ passing through a single diameter D of the small cross-section 5. In this way two wedge-shaped pieces 6 which are cross hatched on FIG. 4 are separated and discarded. The two remaining parts of the cone section 7 which have a rise $R_1$ on the large cross-section 8 of the original section of cone are then brazed.

Figure 5:
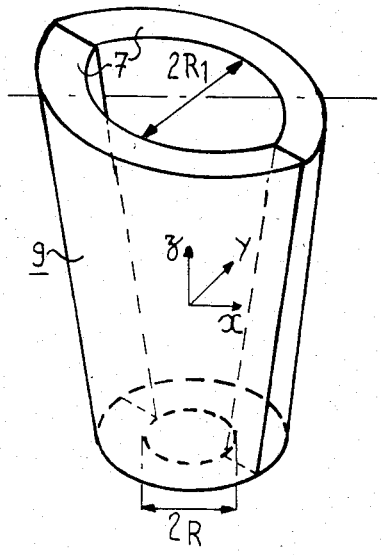
in FIG. 5, the transformer obtained by the process of FIG. 4.

FIG. 5 represents the transformer according to the invention 9 which is obtained in this manner.

Figure 6:
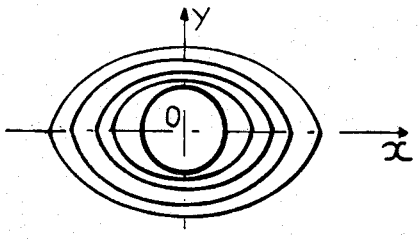
in FIG. 6, a projection of cross-sections taken perpendicular to the Oz axis on the transformer of FIG. 5.

FIG. 6 is a projection of cross-sections taken perpendicular to the Oz axis on the horn represented in FIG. 5. In the example of FIGS. 5 and 6, the minor axis b of the ellipse, measured along the Oy axis, increases slightly along the Oz axis.

Figure 7:
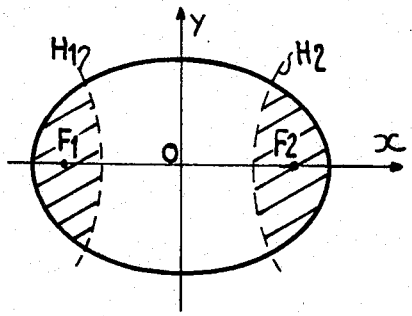
in FIGS. 7 and 8, two diagrams showing the distribution of the electrical field in the cross-section of the transformer according to the invention.

The horn represented in FIG. 5 is a good embodiment of the transformer according to the invention because it is shown that as the eccentricity of an ellipse increases, the electromagnetic energy concentrates between two hyperbolae $H_1$ and $H_2$ having $F_1$ and $F_2$ for foci. FIG. 7 shows an ellipse with its two foci $F_1$ and $F_2$ and the two hyperbolae $H_1$ and $H_2$. If the dimensions of the guide are large in comparison with the wavelength, the distribution of the electrical energy density $E^2$ approximates to a Gaussian function as shown in FIG. 8.

Figure 8:
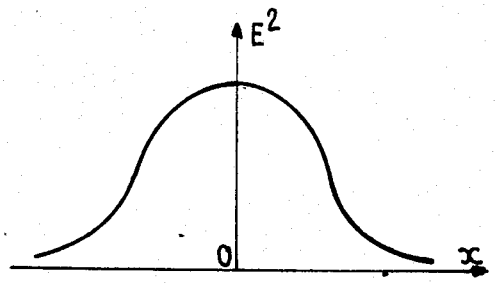

An examination of FIGS. 7 and 8 shows that it is possible, without causing interference, to modify the surfaces of the guide and even the cross-hatched spaces bounded by the hyperbolae $H_1$ and $H_2$ in FIG. 7. In the transformer according to the invention, it can be considered, in order to give the order of magnitude of ellipticity, that in the final cross-section of the transformer, there are several wavelengths between the two foci $F_1$ and $F_2$.

The transformer according to the invention, formed from a guide of elliptical cross-section, of increasing eccentricity, can therefore be produced by the horn in FIG. 5, formed from two parts of a circular cone.

The two half-horns 7 can come from two different sections of cone. It is necessary to obtain a horn comprising two parts of decreasing curvature and of which the distance to the z axis increases slower than the radius of curvature, which will act like ellipses of increasing eccentricity.

Figure 9:
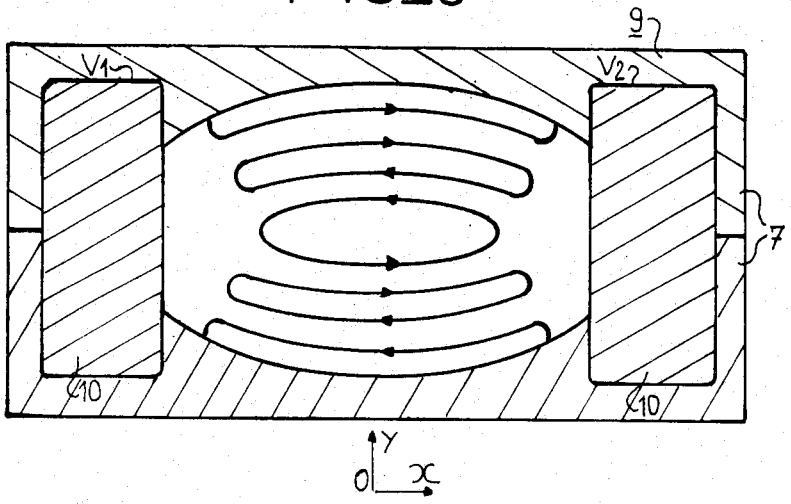
in FIG. 9, the cross-section of a transformer according to the invention including volumes $V_1$ and $V_2$.

In whatever way it is manufactured, the transformer according to the invention can include on the parts near the extremities of the major axis cavities in which there is an absorbent material which absorbs any mode other than the desired mode. FIG. 9 represents the cross-section of a transformer according to the invention obtained by brazing two parts of a section of cone. The parts near the extremities of the major axis have been hollowed out in order to obtain the oblong volumes $V_1$ and $V_2$ which enclose an absorbent material 10. As there is only a very small amount of energy accumulated near the extremities of the major axis, volumes $V_1$ and $V_2$ do not disturb the functioning of the transformer according to the invention.

In FIG. 9, the field lines obtained from a $TE_{02}$ mode in the circular cavity of the gyrotron have been represented. It is noted that the electrical field lines are approximately parallel to the x axis, and therefore to the major axis of the ellipse a.

Figure 10:
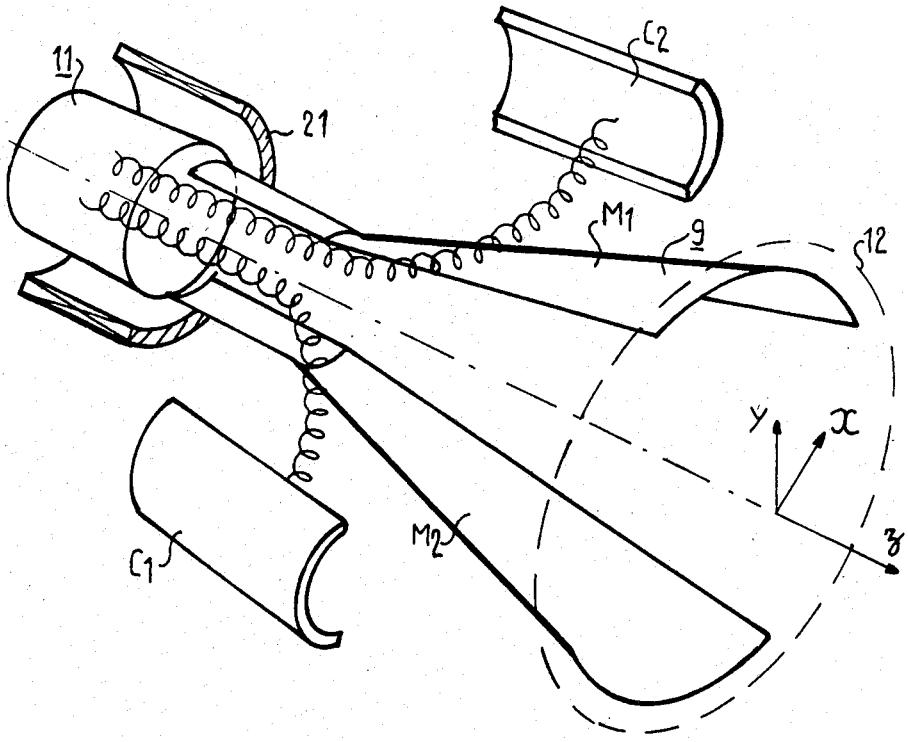
in FIG. 10, a perspective view of an embodiment of a transformer according to the invention including two mirrors $M_1$ and $M_2$ and two collecting zones $C_1$ and $C_2$.

FIG. 10 shows another embodiment of the transformer according to the invention. FIG. 10 is a perspective view in which can be seen, on the left, a gyrotron 11, which is represented symbolically by a cylinder, followed by the mode transformer according to the invention 9 which is formed from two mirrors $M_1$ and $M_2$. These two mirrors are concave. They are arranged on either side of the Oz axis, perpendicular to the y axis, and face each other. These two mirrors are contained in a vacuum enclosure which is not represented in FIG. 10.

On the right of FIG. 10, the outline of the window 12, which provides the vacuum sealing of the enclosure containing the mirrors $M_1$ and $M_2$, is shown as a dotted line.

The transformer according to the invention can be, as is the case in FIG. 10, in the same vacuum enclosure as the gyrotron. It can also be placed at the output of a gyrotron of usual structure.

The shape of the mirrors $M_1$ and $M_2$ is chosen such that the cross-sections perpendicular to the z axis of the transformer according to the invention thus formed are approximately elliptical and have increasing eccentricity along the Oz axis, provided that no account is taken of the extremities of the major axis of these ellipses where it has been seen that the electrical field is very weak.

The transformer according to the invention can produce a change from modes other than $TE_{on}$ modes, into a mode in which the electrical field is approximately parallel to a given direction.

Figure 11:
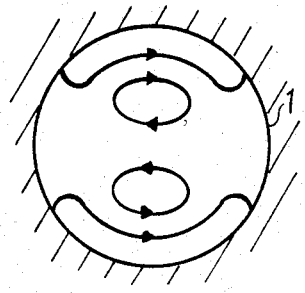
in FIGS. 11 to 14, the electrical field lines in the cross-section of the cavity of the gyrotron and of a transformer according to the invention formed from two mirrors $M_1$ and $M_2$.
Figure 13:
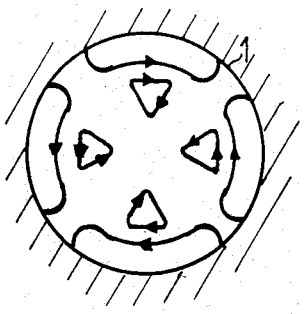

FIGS. 11 and 13 show the electrical field lines in the cross-section of the cavity 1 of the gyrotron when a $TE_{12}$ mode and a $TE_{22}$ mode is established in this cavity.

Figure 12:
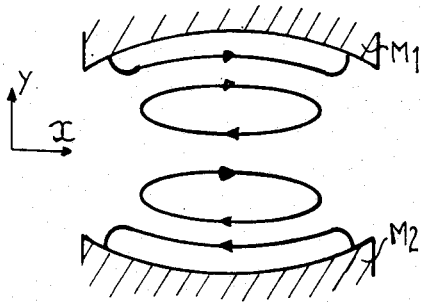
Figure 14:
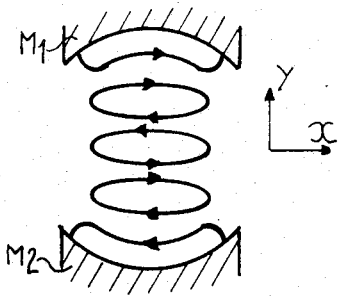

FIGS. 12 and 14 show the electrical field lines in the cross-section of the transformer according to the invention formed from the two mirrors $M_1$ and $M_2$ which is placed after the cavity of a gyrotron in which the $TE_{12}$ mode of FIG. 11 and the $TE_{22}$ mode of FIG. 13 are established respectively. An open guide mode $TE_3$ and an open guide mode $TE_4$ are obtained in the transformer according to the invention. It is noted that the electrical field lines are approximately aligned with the x axis and have three or four successive alternations between $M_1$ and $M_2$.

One of the problems that arises in the gyrotron field is to separate the output circuit collector of the electron beam. FIG. 10 proposes a solution to this problem.

As we move away from the gyrotron, the continuous magnetic field, created by a focusing solenoid 21 arranged around the gyrotron, decreases, the electron beam diverges and strikes the surfaces of the transformer 9.

In order to prevent the impact of electrons on mirrors $M_1$ and $M_2$, focusing means are arranged around the transformer which direct the electron beam onto the collecting plates $C_1$ and $C_2$. These plates are arranged on either side of the Oz axis, perpendicular to the x axis, and face each other. They are therefore located over the parts near the extremities of the major axis of the ellipses forming the cross-section of the transformer. They are contained inside the vacuum enclosure enclosing mirrors $M_1$ and $M_2$.

In FIG. 10 there is a symbolic representation of two electronic trajectories ending on the collector plates $C_1$ and $C_2$.

The focusing means, which are not represented on FIG. 10, can be formed for example from two long coils fixed along the length of the transformer 9, similar to the deflection coils of television tubes, and connected to a DC voltage source. These coils carry currents rotating in opposite directions around the x axis, Collector zones can be provided in other embodiments of the transformer according to the invention when the transformer is placed inside the vacuum enclosure. For example, in the embodiment of FIG. 9 the volumes $V_1$ and $V_2$ can be used to collect the electron beam.

It will now be shown how it is possible to change from one mode in which the electrical field is approximately parallel to a given direction to a plane wave.

The electrical field patterns represented in FIGS. 2, 3, 9, 12 and 14 have the following characteristics in common. There is propagation in the z direction. In the y direction there is a standing wave, and in the x direction there is a slow variation in amplitude, without variation in phase.

Figure 15:
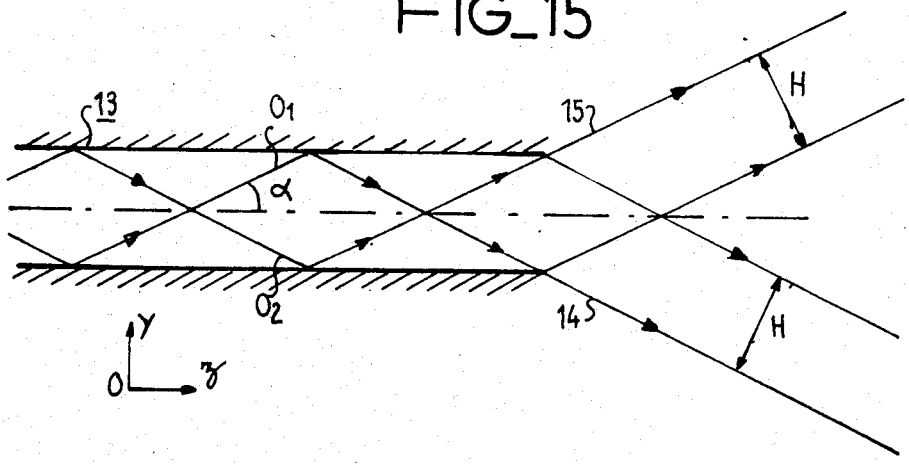
in FIGS. 15 and 16, the items following the transformer according to the invention and producing two plane waves and one plane wave respectively. On the various figures, the same labels indicate the same items, but, for reasons of clarity, the dimensions and proportions of the various items are not respected.

This system of waves can be represented by two crossed plane waves $O_1$ and $O_2$ the paths of which have been represented on FIG. 15 in the yOz plane, in a section of waveguide 13 following the transformer according to the invention and including two surfaces parallel to the Oz axis. This section of waveguide has the same cross-section as the final cross-section of the transformer and has a constant cross-section along the Oz axis. It has been represented on the right of FIG. 15 that when the guide is interrupted, the geometric optic shows that two plane wave beams 14 and 15 are obtained in different directions.

These beams are naturally subject to diffraction, but this is much smaller as the number of plane waves in the width h of the beams increases.

The following equation can be established:

$$\frac{h}{\lambda} = \frac{q}{2tg\alpha},$$

where q is the number of spatial alternations in the cross-section of the transformer, in the y direction, and where $\alpha$ is the angle of incidence of waves $O_1$ and $O_2$ on the Oz axis.

The two beams 14 and 15 remain parallel before diverging by diffraction after a distance $L_R$, called the Rayleigh distance, which is equal to:

$$L_R = \frac{h^2}{\lambda} = \lambda \cdot \frac{q^2}{4t_g{}^2\alpha}$$

For a mode in which q equals 10, a wavelength $\lambda$ of 2 mm, an angle $\alpha$ of 10°, we obtain: $L_R = 804.\ \lambda = 160$ cm.

It is therefore possible to radiate essentially plane waves over a great distance on condition that the transformer according to the invention is followed by a section of waveguide having the same cross-section as the final cross-section of the transformer and having a constant cross-section along the Oz axis.

It is also possible to obtain a single parallel beam from the output of the tube using mirrors placed inside the tube as will be explained with reference to FIG. 16.

Figure 16:
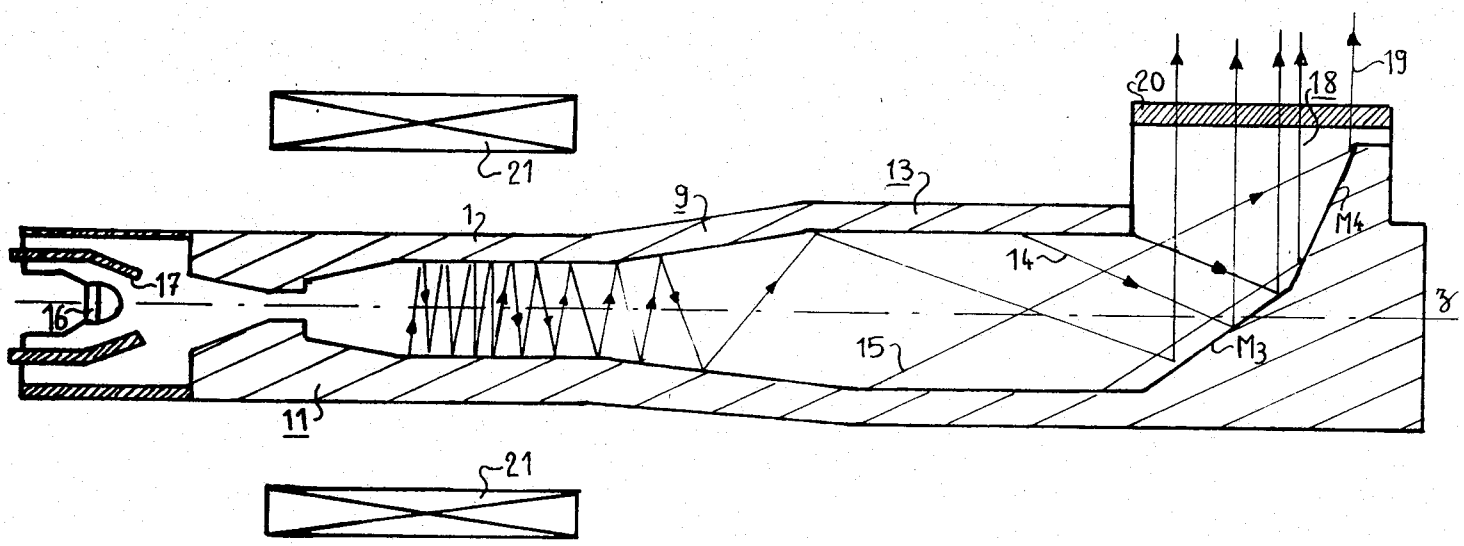

FIG. 16 is a longitudinal cross-section along the Oz axis which shows:

a gyrotron 11, its electron gun including a cathode 16, and an accelerating anode 17, its resonant cavity 1, surrounded by the beam focusing solenoid 12;

a transformer according to the invention 9, of which the cross-section is approximately elliptical and of increasing eccentricity and which can include plates $C_1$ and $C_2$, collecting the electron beam.

a section of waveguide 13 having the same cross-section as the final cross-section of the transformer and of which the cross-section is constant along the z axis;

a final part 18 which enables a single parallel beam 19 to be obtained in place of the two beams 14 and 15 in FIG. 15.

This part 18 includes two mirrors $M_3$ and $M_4$. The inclination of these two mirrors is chosen so that mirror $M_3$ receives plane wave 14 and reflects it vertically on FIG. 16 and so that mirror $M_4$ receives plane wave 15 and also reflects it vertically. It is also necessary that the waves reflected by the two mirrors do not interfere with each other. In the figure, mirror $M_3$ is parallel to wave 15.

Part 18 ends with a window 20 that seals the vacuum and is transparent to radiation.

Mirrors $M_3$ and $M_4$ can be given a spherical or cylindrical curvature in order to compensate over a certain length the diffraction of the beam coming out of the tube through the window.

Part 18 can also enable a single parallel beam to be obtained using only a single curved mirror, more cumbersome than the two mirrors $M_1$ and $M_2$.

The embodiment in FIG. 16 enables the main axis of the tube Oz to be made vertical, which is preferable for its mechanical mounting, while the parallel beam obtained is horizontal which is practical for users.

I claim:

1. A gyrotron which includes means forming an electron beam along a beam axis, a circular cavity into which the beam is projected for interacting with electromagnetic wave energy and creating oscillating wave energy in the cavity, an output wave guide essentially rectangular in cross section in which the electric field is parallel to the major wall of the guide, and an intermediate mode conversion means having one end coupled to the cavity and the other end coupled to the output wave guide comprising a transforming wave guide essentially elliptic in cross section whose eccentricity varies from about zero at said one end to about one at said other end and having a pair of mirrors oppositely disposed along the axis of the beam with openings therebetween, a pair of beam collectors oppositely disposed along the axis of beam at said openings, and means for directing the electron beam after it has traversed the cavity through said openings onto said collector means.

2. A gyrotron in accordance with claim 1 in which the radius of the circular cavity matches the minor axis of the transforming wave guide at its one end.

* * * * *